US005236197A

United States Patent [19]

Chen

[11] Patent Number: 5,236,197

[45] Date of Patent: Aug. 17, 1993

[54] WEIGHT ADJUSTABLE SHOCK AND VIBRATION ABSORBING TENNIS RACKET

[76] Inventor: Dennis Chen, 293 Pei Tun Road, Taichung, Taiwan

[21] Appl. No.: 752,185

[22] Filed: Aug. 23, 1991

Related U.S. Application Data

[63] Continuation of Ser. No. 517,824, May 2, 1990, abandoned.

[51] Int. Cl.[5] ..... H63B 49/02

[52] U.S. Cl. ..... 273/73 C; 273/73 D

[58] Field of Search ..... 273/73 R, 73 C, 73 D, 273/73 G, 73 H, 73 L

[56] References Cited

U.S. PATENT DOCUMENTS 4,314,699 2/1982 Bayer et al. ..... 273/73 D

FOREIGN PATENT DOCUMENTS 1039512 9/1983 U.S.S.R. ..... 273/73 R
2136300 9/1984 United Kingdom ..... 273/73 D
2161391 1/1986 United Kingdom ..... 273/73 C
2186804 8/1987 United Kingdom ..... 273/73 D
2191409 12/1987 United Kingdom ..... 273/73 D

*Primary Examiner*—Edward M. Coven
*Assistant Examiner*—William E. Stoll

[57] ABSTRACT

A weight adjustable, shock and vibration absorbing tennis racket comprising a generally oval shaped headframe with a handle attached thereto, and a striking surface therein formed by stringing the headframe with a string in the conventional manner. A pair of elongate recesses are formed along the inner periphery of the headframe at opposed positions thereon and aligned with the center of percussion of the headframe. A pair of projections are formed on respective opposed longitudinal sides of each recess. A vibration absorbing rib can be releasably secured to each recess, with the ends thereof snap fitting into respective projections of a corresponding recess. String holes for cross strings passing through a recess are arranged in two staggered rows with a pair of adjacent cross strings diverging to a respective pair of adjacent string holes disposed on opposing rows. Adjacent cross strings pass around and contact opposite sides of the corresponding rib when attached. A shock absorbing counterweight can be inserted into each recess, snap fitting around a corresponding rib.

4 Claims, 4 Drawing Sheets

WEIGHT ADJUSTABLE SHOCK AND VIBRATION ABSORBING TENNIS RACKET

This application is a continuation of Ser. No. 07/517,824, filed May 2, 1990, now abandoned.

BACKGROUND OF THE PRESENT INVENTION

The present invention relates to a weight adjustable, shock and vibration absorbing tennis racket, and more particularly to a tennis racket with removable shock and vibration absorbing members that also serve to adjust the weight and balance of the tennis racket.

The weight adjustable, shock and vibration absorbing tennis racket of the present invention is related to a similar weight adjustable, shock and vibration absorbing tennis racket of an allowed patent application, with Ser. No. 07/396,229, by the inventor of the weight adjustable, shock and vibration absorbing tennis racket of the present invention.

In both the above mentioned allowed application and in the present invention, a weight adjustable, shock and vibration absorbing tennis racket is provided with recesses formed on the inner periphery of the headframe thereof, with an elongate vibration absorbing member disposed across each recess.

Strings passing through each recess pass around and contact a corresponding vibration absorbing member so that concomitant vibrations created in the strings when a ball impacts the striking surface of the tennis racket are largely absorbed therein.

A counterweight member, made from an elastic, shock absorbing material can also be disposed within each recess in both the weight adjustable, shock and vibration absorbing tennis racket of the above mentioned allowed application and in that of the present invention.

The counterweight members are in intimate contact with a substantial portion of the headframe of the racket and absorb a considerable amount of the shock created therein when a ball impacts the striking surface of the racket.

The counterweight members are also releasably secured to the headframe and can be manufactured in a variety of weights enabling a user to vary the weight and balance of his or her racket by selecting counterweight members of appropriate weight.

In the weight adjustable, shock and vibration absorbing tennis racket of the present invention, however, the vibration absorbing members are also releasably secured to the headframe thereof and available in a variety of weights, so that a user has another independent method of adjusting the weight and balance of his or her racket by selecting vibration absorbing members of appropriate weight.

SUMMARY OF THE PRESENT INVENTION

The weight adjustable, shock and vibration absorbing tennis racket of the present invention has as a first objective to provide a tennis racket with shock and vibration absorbing members releasably secured therein that absorb concomitant shock and vibrations created in the headframe and strings, respectively, when a ball impacts the striking surface of the tennis racket, and a second objective of providing a tennis racket with releasably secured shock and vibration absorbing members that can be mounted or removed without the need of unstringing the racket and that are available in a variety of weights so as to enable a user to adjust the weight and balance of his or her racket.

The weight adjustable, shock and vibration absorbing tennis racket of the present invention comprises a generally oval shaped headframe with a handle attached thereto, and a striking surface disposed therein consisting of a criss-crossing network of mainstrings and cross strings, formed by a string threaded through a plurality of string holes formed around the periphery of the headframe.

The headframe has a roughly fluke shaped cross-section with an inner periphery having inwardly sloping lateral sides and a flattened innermost portion.

A pair of elongate and arcuate recesses are formed along respective opposed portions of the inner periphery of the headframe, aligned laterally with the center of percussion of the striking surface therein. Each recess extends laterally from the innermost portion of the inner periphery to the base thereof.

Each recess has a curved rear surface and adjoining rounded end portions on respective longitudinal sides thereof.

A pair of generally cylindrical and roughly aligned projections are formed on respective end portions of each recess, disposed near the innermost portion of the inner periphery.

A protruding annular catch is formed around each projection near the ends thereof.

A curved rib of generally cylindrical cross-section is made from an elastic, vibration attenuating material and has a cylindrical cavity formed in each end. Each cylindrical cavity has a recessed annular groove formed therein for receiving an annular catch of a respective projection.

A curved rib can be releasably secured between each pair of projections by first flexing a rib inwards so that the ends thereof are displaced towards each other, and positioning the rib between the projections so that the cavities therein contact the end portions of the respective projections. The rib is then flexed outwards to cause the cavities therein to insert over respective projections with the annular grooves snap fitting over respective annular catches.

A curved rib can be removed from the headframe by pressing the central portion inwards, causing the ends thereof to flex inward and disengage from respective projections.

The string holes formed around the periphery of the headframe are generally aligned with the central plane thereof. String holes passing through the area of the recesses, however, are aligned on two staggered rows disposed above and below the central plane of the headframe.

Cross strings passing through a recess diverge from the central plane of the headframe after passing around a main string in closest proximity to the recess.

Any pair of adjacent cross strings slant in opposite directions from the central plane of the headframe and pass through respective adjacent string holes on opposing rows.

With a rib installed in a corresponding recess, the cross strings passing through the recess pass around and are in contact with a portion of the rib. Cross strings that slant above the central plane of the headframe pass around and contact an upper portion of the rib, while cross strings that slant below the central plane of the headframe pass around and contact a lower portion of the rib.

When the striking surface of the tennis racket of the present invention strikes a ball, concomitant vibrations in the cross strings passing through a recess are largely attenuated by the corresponding rib.

An elongate and arcuate shock absorbing counterweight, made from a pliant, elastic material and with a longitudinal span and curvature roughly equal with that of the recesses can be inserted into a recess through the top thereof.

A longitudinal recessed groove of generally semicircular cross section is formed along an inner peripheral portion of the counterweight.

A plurality of planar slits are formed along the counterweight, with each slit extending from an inner peripheral portion thereof to the outer peripheral wall of the counterweight, the spacing between adjacent slits being substantially equal with the spacing between adjacent cross strings. Each slit has a lower opening extending laterally across the lower side of the counterweight.

A counterweight can be releasably secured within a recess by inserting the counterweight over the top thereof with the cross strings sliding into corresponding slits and the groove therein snap fitting over and abutting the outer side of a corresponding rib.

The counterweight can be removed from a recess by pushing it outwards from the bottom of the recess.

When mounted, a counterweight is in intimate contact with a substantial portion of the headframe and, being made from an elastic material, absorbs a considerable amount of the shock created in the headframe when a ball impacts the striking surface therein.

The first objective of the present invention is thereby achieved.

As both the vibration absorbing rib and shock absorbing counterweight can be mounted or removed from the headframe without having to unstring the racket, and can be manufactured in a variety of weights, a user can conveniently adjust the weight and balance of his or her racket by selecting ribs or counterweights of appropriate weight.

The second objective of the present invention is thus also achieved.

A detailed description of the structure and function of the weight adjustable, shock and vibration absorbing tennis racket of the present invention is provided in the preferred embodiment below along with accompanying drawings.

A BRIEF DESCRIPTION OF THE DRAWINGS

PREFERRED EMBODIMENT OF THE PRESENT INVENTION

Figure 1:
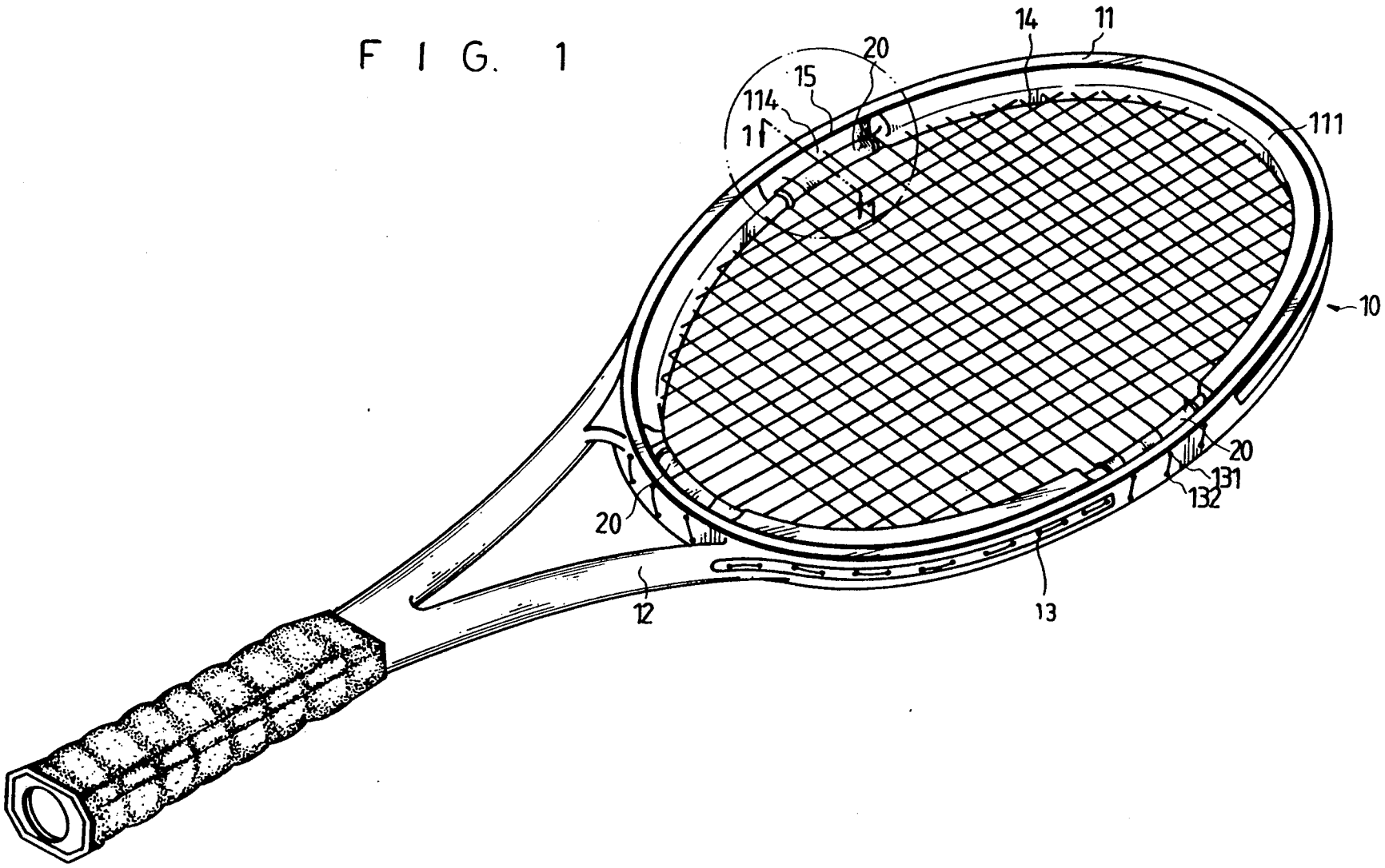
FIG. 1 is a perspective view of an embodiment of the weight adjustable, shock and vibration absorbing tennis racket of the present invention.

Referring to FIG. 1, the weight adjustable, shock and vibration absorbing tennis racket of the present invention comprises an oval-shaped headframe 11 threaded with a catgut string 14 in a conventional manner to form a striking surface therein, with a pair of bars 12 extending outwardly from the shoulders of headframe 11 and converging to a handle attached thereto to define a yoke.

Figure 5:
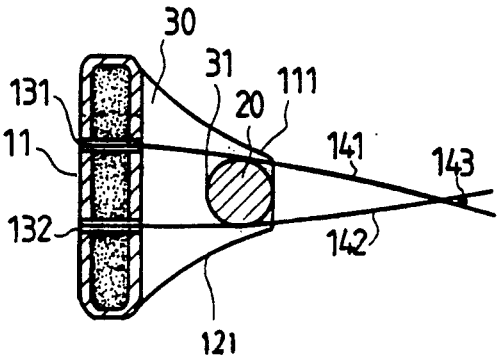
FIG. 5 is a cross-sectional view taken along line 2—2 of FIG. 4, showing cross strings passing through a recess diverging above and below a rib and making contact therewith, of an embodiment of a weight adjustable, shock and vibration absorbing tennis racket of the present invention.

Referring also to FIG. 5, headframe 11 has a roughly fluke shaped cross-section with an inner periphery consisting of a pair of arcuate, concave lateral sides 111 and 121, sloping inwardly to adjoin with a flattened inner ledge 113.

A pair of elongate and arcuate recesses 15 are formed along respective portions of the inner periphery of headframe 11, at opposed positions thereon and aligned with a transverse line passing through the center of percussion of the striking surface of headframe 11, laterally extending from ledge 113 to the base of lateral sides 111 and 121.

Each recess 15 defines a singly curved rear surface 114 with an adjoining rounded end portion 151 on respective opposing longitudinal sides thereof.

Each rear surface 114 has a width comparable with the width of headframe 11, as measured along a perpendicular direction with respect to the plane of the striking surface therein, and has a curvature substantially equal and concentric with that of the corresponding portion of the outer periphery of headframe 11 opposite therefrom.

Figure 3:
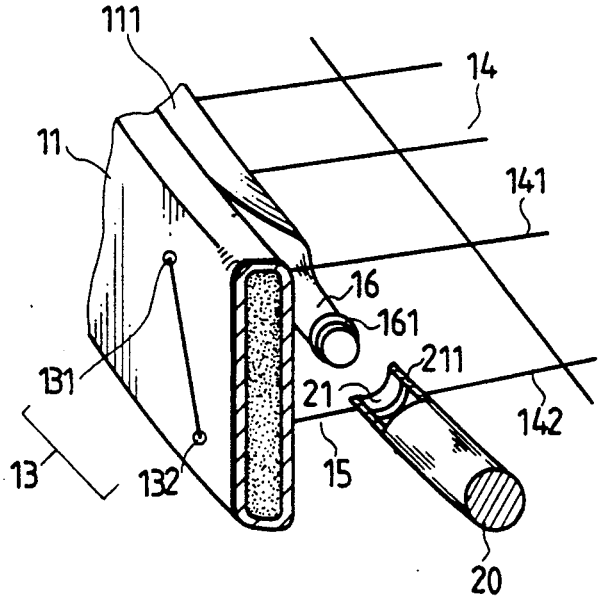
FIG. 3 is a cut-away view of a recess formed on the inner periphery of a headframe, of an embodiment of the weight adjustable, shock and vibration absorbing tennis racket of the present invention, showing a projection formed on a side of the recess and a section of a rib with an end thereof cut-away to reveal a hollow cavity therein.
Figure 2:
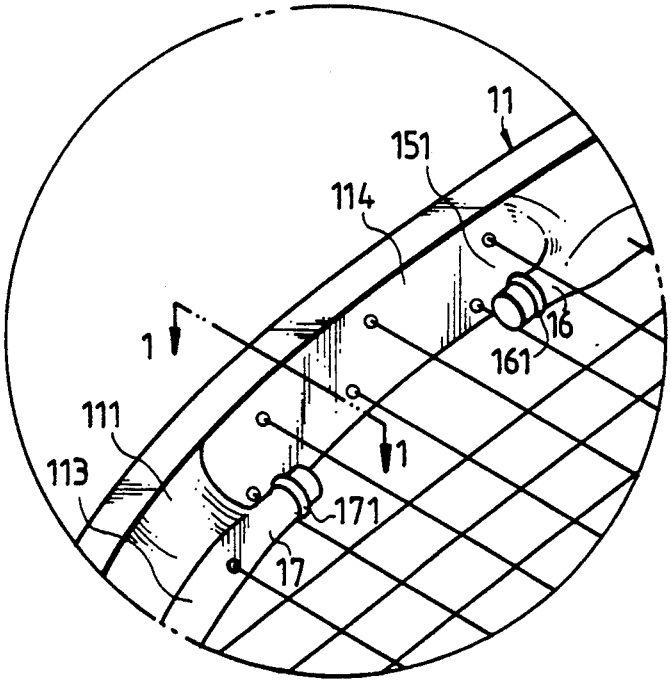
FIG. 2 is a close up view of the circled area of FIG. 1, showing a recess formed on the inner periphery of a headframe, with a pair of projections formed on respective opposing sides thereof, of an embodiment of the weight adjustable, shock and vibration absorbing tennis racket of the present invention.

Referring to FIGS. 2 and 3, a pair of generally cylindrical and roughly aligned projections, 16 and 17, are formed on respective opposing end portions 151 of each recess 15, disposed slightly below adjoining inner ledge 113 and in a central position between the inner portions of respective lateral sides 111 and 121.

A protruding annular catch 161 and 171 are formed around respective cylindrical projections, 16 and 17, in proximity to the ends thereof.

Referring also to FIG. 1, a curved rib 20 of generally cylindrical cross-section is made from an elastic, vibration attenuating material and has a concentric cylindrical cavity 21 provided on each end thereof. A recessed annular groove 211 is formed concentrically within each cylindrical cavity 21.

The longitudinal span of curved rib 20 is greater than the distance separating the terminal ends of respective projections 16 and 17, but the distance between annular grooves 211 therein is comparable with the separation between annular projections 161 and 171.

A curved rib 20 can be releasably secured between each pair of projections, 16 and 17, of each respective recess 15, by first manually flexing curved rib 20 inwards, with the ends thereof displaced towards each together, and positioning curved rib 20 within a corresponding recess 15 with hollow cavities 21 therein in contact with the ends of respective projections 16 and 17.

Curved rib 20 is then flexed outwards so that hollow cavities 21 therein are inserted over respective projections 16 and 17. Annular grooves 211 in respective hollow cavities 21 snap fit over respective annular catches 161 and 171 to releasably secure curved rib 20 to headframe 11.

When secured to headframe 11, a curved rib 20 has a curvature substantially equal and concentric with that of rear surface 114 of the corresponding recess 15 and corresponding portion of the outer periphery of headframe 11.

A curved rib 20 can be removed from headframe 11 by pressing the central portion thereon towards rear surface 114 of the corresponding recess 15, causing the ends thereof to flex inwards and disengage annular grooves 211 from respective corresponding annular catches 161 and 171.

Referring to FIG. 1, a plurality of string holes 13 are formed around the periphery of headframe 11 at predetermined positions, with each string hole 13 extending from the outer periphery to the inner periphery thereof, and are aligned with the central plane of headframe 11.

Figure 4:
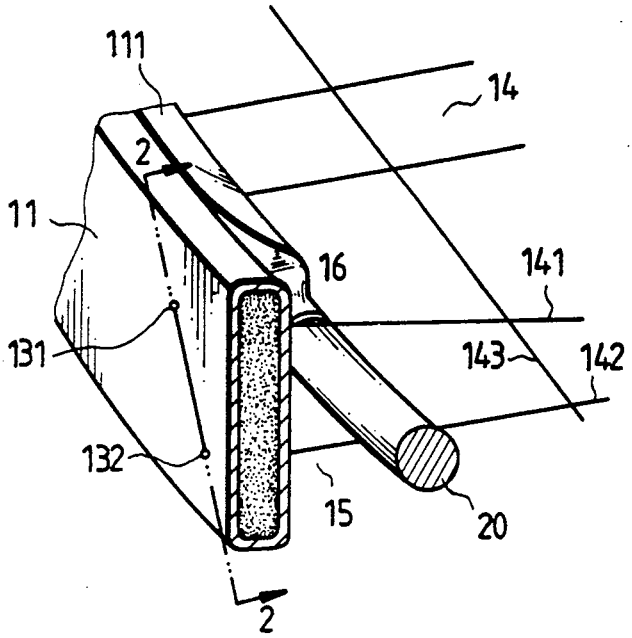
FIG. 4 is a sectional perspective view taken along line 1—1 of FIG. 1, of an embodiment of the weight adjustable, shock and vibration absorbing tennis racket of the present invention, showing a projection formed on a side of the recess with a section of a rib releasably secured thereon.

String holes 131 and 132 formed on the portions of headframe 11 corresponding to the positions of recesses 15, however, are disposed respectively along two staggered rows, equally spaced above and below the central plane of headframe 11, respectively, and parallel therewith, as shown in FIGS. 1 and 4.

A catgut string 14 is threaded through stringholes 13, 131, and 132 in the conventional manner to form a striking surface consisting of a criss-crossing network of orthogonally aligned main strings and cross strings.

Referring to FIGS. 4 and 5, adjacent cross strings 141 and 142 passing through a recess 15 diverge in opposite directions from the central plane of headframe 11 after passing around a mainstring 143, in closest proximity to recess 15.

Cross string 141 slants above the central plane of headframe 111, passing around the corresponding rib 20 and contacting the upper portion thereof, to thread through a corresponding string hole 131 of the upper row.

Similarly, cross string 142 slants below the central plane of headframe 11, passing around the corresponding rib 20 and contacting the lower portion thereof, to thread through a corresponding string hole 132 of the lower row.

All cross strings passing through a recess 15 are similarly arranged, with any pair of adjacent cross strings passing through respective adjacent string holes disposed on opposite sides of the central plane of headframe 11 and in contact with roughly opposing portions of the corresponding rib 20.

When the striking surface of the tennis racket of the present invention impacts a ball, concomitant vibrations in the cross strings passing through a recess 15 are largely attenuated by the corresponding rib 20.

As vibration absorbing ribs 20 can be manufactured in a variety of weights, a user can also adjust the weight and balance of the racket by selecting ribs 20 of appropriate weight.

Alternately, cross strings passing through a recess 15 may pass above or below a rib 20, being separated therefrom by a small gap with a nominal separation of 0.15 mm. Strong vibrations in the cross strings would still be largely absorbed as the resultant lateral displacements thereof would cause contact with rib 20.

A rib 20 can be secured to a pair of projections 16 and 17 of a corresponding recess 15 after headframe 11 has been strung by first inserting rib 20 between the diverging cross strings from a side area of recess 15. A mounted rib 20 can be similarly removed by first disengaging annular grooves 211 from respective catches 161 and 171 and passing rib 20 out of recess 15 through a side area thereof.

Figure 6:
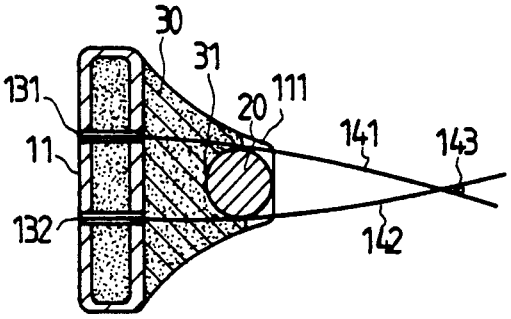
FIG. 6 is a cross-sectional view as in FIG. 5, showing a shock absorbing counterweight releasably secured within a recess, of an embodiment of the weight adjustable, shock and vibration absorbing tennis racket of the present invention.

Referring to FIG. 6, an elongate and arcuate shock absorbing counterweight 30, made from a pliant, elastic material and with a longitudinal span and curvature roughly equal with that of recesses 15, can be releasably secured within each recess 15.

Counterweight 30 has an outer peripheral wall with a shape and dimensions comparable with that of rear surface 114 of recess 15, adjoining with a pair of inwardly sloping arcuate, concave lateral sides that are flush with lateral sides 111 and 121 of headframe 11 when counterweight 30 is mounted in recess 15.

A longitudinal recessed groove 31 of generally semicircular cross section, with a radius comparable with that of rib 20, is formed along the inner periphery of counterweight 30 between the inner portions of the lateral sides thereof in a central position.

A plurality of planar slits (not shown) are formed along counterweight 30 at pre-determined positions, with each slit extending from a rim of groove 31 to the outer peripheral wall thereof. Each slit has a lower opening extending laterally across the lower lateral side of counterweight 30 for the insertion of a cross string.

The spacing between adjacent slits therein is substantially equal with the spacing between adjacent cross strings, with the plane of each slit being aligned with a corresponding cross string and perpendicular with the central plane of headframe 11 when counterweight 30 is mounted.

Counterweight 30 is releasably secured within a recess 15 by inserting counterweight 30 over the top thereof with each cross string slided into a corresponding slit and groove 31 snap fitting over and abutting the outer side of the corresponding rib 20. The outer peripheral wall of counterweight 30 abuts the entire area of the rear surface 114 of recess 15.

Cross strings passing around the upper portion of the corresponding rib 20 have corresponding slits of greater depth than the corresponding slits of cross strings which pass around the lower portion of rib 20.

The inner terminations of the slits of greater depth extend linearly from the upper rim of groove 31 to a corresponding thread hole 131 of the upper row adjacent to the rear wall of counterweight 30, and the inner terminations of the slits of lesser depth extend linearly from the lower rim of groove 31 to a corresponding thread hole 132 of the lower row adjacent to the rear wall thereof.

Counterweight 30 can be removed from a recess 15 by pushing it outwards from the bottom thereof. As with vibration absorbing rib 20, the mounting or removal of counterweight 30 does not require the unstringing of the headframe 11.

As counterweight 30 is in intimate contact with a substantial portion of the inner periphery of headframe 11 and is made from an elastic material, a considerable amount of shock created when a ball impacts the striking surface is absorbed therein.

Moreover, as counterweight 30 can be manufactured in a variety of weights, a user can select appropriate counterweights 30 to adjust the weight and balance of the racket.

Though in the above embodiment, a pair of opposed recesses disposed laterally across the center of percussion of the racket was shown, a recess and attached vibration absorbing rib may also be formed along a portion of the inner periphery of the headframe aligned with a longitudinal line passing through the center of percussion of the striking surface therein, and does not necessarily have to be paired with an opposing recess. As an example, as shown in FIG. 1, a recess 15 with a corresponding rib 20 is disposed on the inner periphery of headframe 11 near the throat area of the racket.

In the latter case, main strings passing through recess 15 would diverge above or below the central plane of headframe 11 after passing the cross string in closest proximity thereto, with adjacent main strings slanting in opposite directions to pass around opposing portions of the corresponding rib 20 and thread through corresponding adjacent string holes on opposing rows, in the same manner as with the cross strings of the laterally aligned recesses 15.

A corresponding counterweight 30 for recess 15 disposed near the throat area of the racket would have planar slits with a spacing substantially equal with the spacing between adjacent main strings for the receiving of the main strings therein.

Though the above exposition contains many specificities, these should not be interpreted as limitations on the scope of the present invention but merely as one mode of realization according to a preferred embodiment thereof. As such, the scope of the present invention should be determined by the appended claims.

I claim :

1. A weight adjustable and vibration absorbing tennis racquet comprising a generally oval shaped headframe with a plurality of string holes formed thereon at predetermined positions and aligned with the central plane of said headframe, with a string threaded through said string holes to form a striking surface therein consisting of an orthogonal network of criss crossing main strings and cross strings, wherein:

said headframe has an inner periphery and an outer periphery;

at least one elongate, arcuate recess is formed at a predetermined position along said inner periphery of said headframe aligned with a lateral or longitudinal line passing through the center of percussion of said striking surface, with each said recess laterally extending from the innermost portion of said inner periphery to the base thereof;

each said recess has a rear surface with a pair of adjoining opposed end portions on respective longitudinal sides thereof, a pair of roughly aligned connecting elements are formed on respective said end portions of each said recess, in proximity to the innermost portion of said inner periphery;

an elongate rib made from an elastic, vibration attenuating material has a pair of opposed end portions which can be releasably secured to respective said connecting elements of a corresponding said recess by a releasable securing means;

said string holes for threading said cross strings passing through said recesses are arranged in two staggered rows, with a first row disposed above the central plane of said headframe and a second row disposed below the central plane of said headframe;

said cross strings passing through a said recess diverge away from the central plane of said headframe after passing around the said main string in closest proximity to the respective said recess, with each pair of adjacent cross strings slantings in opposite directions from the central plane of said headframe so that one said cross string of the adjacent pair threads through a corresponding said string hole on said first row and the other said cross string of the adjacent pair threads through a corresponding adjacent said string hole on said second row;

said cross strings passing through a said recess pass around and are in contact with a corresponding said rib when secured to said projections of the respective said recess, with said cross strings passing through said string holes of said first row contacting an upper portion of said rib and said cross strings passing through said string holes of said second row contacting a lower portion of said rib;

said main strings passing through a said recess diverge away from the central plane of said headframe after passing around the said cross string in closest proximity to the respective said recess, with each pair of adjacent main strings slanting in opposite directions from the central plane of said headframe so that one said main string of the adjacent pair threads through a corresponding said string hole on said first row and the other said main string of the adjacent pair threads through a corresponding adjacent said string hole on said second row;

said main strings passing through a said recess pass around and are in contact with a corresponding said rib when secured to said projections of the respective said recess, with said main strings passing through said string holes of said first row contacting an upper portion of said rib and said main strings passing through said string holes of said second row contacting a lower portion of said rib;

whereby, when secured to said headframe each said rib absorbs concomitant vibrations created in said cross strings passing through said recesses when a ball impacts said striking surface of said racket; and said ribs can be manufactured in a variety of weights, enabling a user to adjust the weight and balance of said racket by selecting said ribs of appropriate weight.

2. A weigh adjustable and vibration absorbing tennis racket according to claim 1, wherein:

said pair of connecting elements within each said recess comprises a pair of respective elongated projections;

said releasable securing means comprises a pair of protruding annular catches formed around a respective elongate projection in proximity to respective terminal ends thereof, and a pair of hollow cavities formed within respective said ends portions of said rib, with a recessed annular guide formed within each said cavity;

whereby, said rib can be releasably secured within a corresponding said recess by first flexing said rib inwards so as to displace said end portions thereon towards each other and positioning said rib within said recess so that said hollow cavities therein are in contact with the end portions of respective said projections, said rib is then flexed outwards so that said hollow cavities therein are inserted over the end portions of respective said projections with annular guides snap fitting over said annular catches.

3. A weight adjustable and vibration absorbing tennis racket according to claim 1, wherein:

an elongate and arcuate shock absorbing counterweight made from an elastic, pliant material and having a longitudinal span and curvature roughly equal with that of corresponding said recesses is further provided;

a plurality of planar slits are formed along said counterweight at predetermined positions, with each said slit extending laterally from an inner peripheral portion of said counterweight to an outer peripheral wall thereof and each said slit having a lower opening extending laterally across the lower portion of said counterweight, and with the spacing between adjacent said slits being substantially equal with the spacing between adjacent said cross strings or said main strings;

said counterweight can be inserted into a corresponding said recess through the top thereof, with said main strings or said main strings passing through said recess sliding into corresponding said slits therein, and with said counterweight abutting a substantial portion of said headframe;

said counterweight is releasably secured within said recess by a releasable securing means; whereby, said counterweight abuts a substantial portion of said headframe when secured therein, and absorbs a considerable amount of concomitant shock created when a ball impacts said striking surface of said tennis racket;

said counterweights can be manufactured in a variety of weights, enabling a user to adjust the weight and balance of said racket by selecting said counterweights of appropriate weight.

4. A weight adjustable and vibration absorbing racket according to claim 3, wherein:

said releasable securing means securing said counterweight to a corresponding said recess comprises an elongate, recessed groove formed along an inner peripheral portion of said counterweight in a longitudinal direction, said groove having a cross section of generally equal shape and dimensions with the cross section of an outer portion of a corresponding said rib;

whereby, when said counterweight is inserted into a corresponding said recess, said groove therein snaps fit over and abuts an outer portion of the corresponding said rib to releasably secure said counterweight within a corresponding said recess.

* * * * *